US009175465B2

(12) United States Patent
Rinkenback

(10) Patent No.: US 9,175,465 B2
(45) Date of Patent: Nov. 3, 2015

(54) SECURABLE DRAIN SCREEN HAVING LOCKABLE ACCESS

(71) Applicant: David Rinkenback, Gardner, KS (US)

(72) Inventor: David Rinkenback, Gardner, KS (US)

( * ) Notice: Subject to any disclaimer, the term of this patent is extended or adjusted under 35 U.S.C. 154(b) by 235 days.

(21) Appl. No.: 14/059,814

(22) Filed: Oct. 22, 2013

(65) Prior Publication Data

US 2014/0158592 A1 Jun. 12, 2014

Related U.S. Application Data

(60) Provisional application No. 61/735,667, filed on Dec. 11, 2012.

(51) Int. Cl.
*E03F 5/04* (2006.01)
*E03F 5/06* (2006.01)

(52) U.S. Cl.
CPC ..... *E03F 5/06* (2013.01); *E03F 5/0404* (2013.01); *E03F 5/0407* (2013.01); *E03F 2005/063* (2013.01); *E03F 2005/066* (2013.01)

(58) Field of Classification Search
CPC ..... E03F 5/0404; E03F 5/0407; E03F 5/06; E03F 2005/0412; E03F 2005/063; E03F 2005/066
USPC ..... 210/163, 164, 232, 474; 4/286, 290, 4/292; 404/4, 5
See application file for complete search history.

(56) References Cited

U.S. PATENT DOCUMENTS

| | | | | |
|---|---|---|---|---|
| 5,324,135 | A * | 6/1994 | Smith | 210/164 |
| 5,405,539 | A * | 4/1995 | Schneider | 210/163 |
| 5,643,445 | A * | 7/1997 | Billias et al. | 210/163 |
| 6,178,565 | B1 * | 1/2001 | Franco | 210/163 |
| 6,330,724 | B1 * | 12/2001 | Belle | 4/286 |
| 6,567,996 | B2 * | 5/2003 | Rao | 4/292 |
| 6,802,962 | B1 * | 10/2004 | Browne et al. | 210/164 |
| 7,771,591 | B2 * | 8/2010 | Lucas | 210/163 |
| 2001/0030150 | A1 * | 10/2001 | Remon | 210/163 |
| 2005/0051499 | A1 * | 3/2005 | Nino | 210/163 |
| 2005/0183997 | A1 * | 8/2005 | Happel et al. | 210/163 |
| 2013/0008851 | A1 * | 1/2013 | Jarvis et al. | 210/499 |

* cited by examiner

*Primary Examiner* — Christopher Upton
(74) *Attorney, Agent, or Firm* — Daniel Boudwin; Global Intellectual Property Agency LLC

(57) ABSTRACT

A securable drain screen is provided having a rectangular frame, a lockable screen door, and upstanding screen sidewalls forming a rectangular trap with an open upper that is adapted to block large debris from entering a drain and clogging the same when deployed. Along the perimeter of the frame and positioned against each sidewall exterior surface is an extendable footer element that is threadably attached thereto and extendable outwards for bearing against the interior surface of a drain. The footers bear against the drain interior and securably position the assembly within the drain, while the lockable screen door therethrough is hinged for access through the device when snaking the drain. The hinged door includes a padlock latch for securing the door in a closed position, whereby only authorized users can remove the screen from the drain once deployed.

5 Claims, 3 Drawing Sheets

SECURABLE DRAIN SCREEN HAVING LOCKABLE ACCESS

CROSS REFERENCE TO RELATED APPLICATION

This application claims the benefit of U.S. Provisional Application No. 61/735,667 filed on Dec. 11, 2012, entitled "Locking Sediment Basket." The above identified patent application is herein incorporated by reference in its entirety to provide continuity of disclosure.

BACKGROUND OF THE INVENTION

1. Field of the Invention

The present invention relates to drain covers and drain screens. More specifically, the present invention pertains to a lockable drain cover that is particularly well adapted for floor drains and for securably deploying therein for the purposes of capture large object debris that cannot otherwise be sent into the drain.

Floor drains are useful plumbing fixtures that permit draining of any standing water in the adjacent floor area, allowing for efficient fluid drainage without resorting to pumping or other water removal means. These types of drains are commonly found in commercial areas, restaurants and kitchens, hospitals, and industrial settings for draining fluid from the area. Covering these drains is a drain screen, which traps large debris and prevents the drain from rapidly becoming clogged. The screens are generally placed over the drain opening, or are fastened thereto using a common hardware fastener.

In some environments, these covers may be removed by workers to facilitate cleaning debris from the area, whereby the screen is removed to allow for fluid, sediment, and other debris to enter the drain. This shortcut to cleaning causes the drain to quickly become clogged and cease functioning, which can cause backups and water damage to the area. In some cases, the screen may not be fastened to the cover, or a make-shift cover may be deployed that is readily removable by facility workers.

The present invention pertains to a new and novel floor drain screen that is adapted to prevent removal thereof from the drain, while also permitting access into the drain for authorized personnel to conduct drain snaking and cleaning activities. The device comprises a drain screen that acts as a particulate trap, wherein screen is supported by a frame that includes extension footers that are threadably attached to the frame and are adapted to bear against the interior of the drain while deployed. Once installed, access to the fasteners is limited by a hingeable door within the frame, where the door is securable using a pad lock or similar locking means. In this way, the device acts as a drain screen and security device to prevent workers from sweeping or otherwise stuffing debris into the drain without authorization. The assembly also facilities cleaning of the drain interior without complete removal thereof.

2. Description of the Prior Art

Devices have been disclosed in the prior art that relate to floor drains and drain screens. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 6,567,996 to Rao, which discloses a lock for securing a drain screen in place, wherein the screen is secured by way of a threaded bolt that enters the drain interior and connects to a lateral bore and cross brace member. The cross brace bears against the interior walls of the pipe and supports the threaded bolt, which bears down onto the upper portion of the drain screen. An specialized installation tool is further disclosed for setting the cross brace in the drain, whereafter the threaded bolt is secured thereto using a non-standard head for security purposes. The Rao device provides a drain screen and security device therefor. The elements of Rao device, while suitable for supporting a screen, significantly depart from the elements of the present invention.

Similar to the Rao device is U.S. Pat. No. 6,330,724 to Belle, which discloses a drain cover locking device that utilizes an interior drain support element that is used to fasten a drain screen into place. Within the interior of the drain is a threaded rod having a pair of L-shaped hanger elements at each end. The hanger elements suspend the threaded rod from the opening of the drain, while the rod can be rotated by a tool to bear the hanger elements against the walls of the drain. A fastener is fed through the screen and into the threaded rod for securing the drain into place. While this assembly secures a drain cover from below, it provides no means of trapping particulates and other solid matter entering the drain for later removal. The present invention relates to a securable drain trap that requires tools to remove, yet traps dirt, debris, and other articles before entering the drain.

Other articles in the prior art related to securing mechanisms and larger assemblies that secure a typical drain cover. These articles, while novel and useful in their own right, fail to disclose the structure and functional aspects of the present invention. It is submitted that the present invention is substantially diverges in design elements from the prior art, and consequently it is clear that there is a need in the art for an improvement to existing drain cover devices. In this regard the instant invention substantially fulfills these needs.

SUMMARY OF THE INVENTION

In view of the foregoing disadvantages inherent in the known types of drain screen devices now present in the prior art, the present invention provides a new, lockable and securable drain screen that can be utilized for providing convenience for the user when preventing large debris from entering a drain and trapping the debris within an open screen frame for subsequent removal, while at the same time ensuring the drain screen is not removable without authorized access.

It is therefore an object of the present invention to provide a new and improved drain screen device that has all of the advantages of the prior art and none of the disadvantages.

It is another object of the present invention to provide a drain screen device that is securable within the interior of a drain for trapping large debris from entering therein, including food items, rags, and other articles that would otherwise clog the drain or are unsuitable for downstream processing.

Another object of the present invention is to provide a drain screen device that is securable within a drain interior and cannot be removed without tools for the purpose of preventing unauthorized dumping or depositing of articles into the drain for which the drain is unsuited.

Yet another object of the present invention is to provide a drain screen device that includes a hingeable access door that allows authorized users to open for drain cleaning and snaking purposes, whereby the assembly can remain in position while the drain is cleaned and a lock is utilized to secure the door closed when otherwise deployed.

Another object of the present invention is to provide a drain screen device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
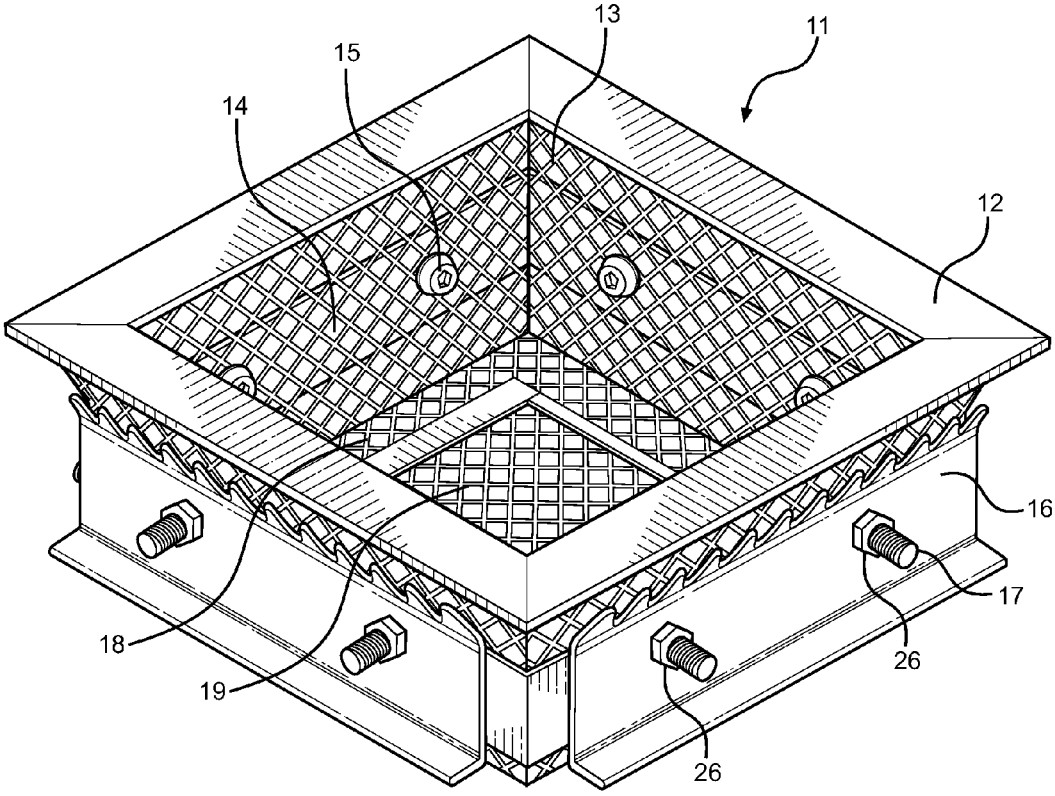
FIG. 1 shows an overhead perspective view of the drain screen device of the present invention.

Reference is made herein to the attached drawings. Like reference numerals are used throughout the drawings to depict like or similar elements of the drain screen device. For the purposes of presenting a brief and clear description of the present invention, the preferred embodiment will be discussed as used for preventing large debris from being deposited into the drain and for preventing access therethrough to unauthorized personnel. The figures are intended for representative purposes only and should not be considered to be limiting in any respect.

Referring now to FIG. 1, there is shown a perspective view of the drain screen device of the present invention. The device is a securable drain cover or trap that is adapted for placement over an open drain and for trapping large debris items from entering therein. The device prevents items such as rags, trash, and other debris from being deposited into the drain and causing a clog or backup. It is not uncommon for floor drains to be utilized as a catch-all during cleaning activities, particularly in commercial and industrial environments where considerable trash, debris, and sediment can be collected on the floor. To prevent these debris items from being washed down the floor drain, as opposed to being properly picked up and disposed of, the present invention contemplates a lockable drain cover that permits open access therethrough only to authorized personnel.

The drain screen assembly comprises a frame 11 having upstanding sidewalls 13, a base surface 18, and an upper ledge surface 12. The upper ledge surface 12 extends from the upper edge of the frame sidewalls 13 and is adapted to provide an overhang element that rests above the drain interior when installed. The base surface 18 and the upstanding sidewalls 13 form a largely rectangular assembly having a closed bottom and an open upper. The base surface 18 and a majority of the sidewalls 13 are comprised of a screen material or apertured surface such that fluid can pass therethrough while larger debris is trapped within the open interior of the frame 11. In this way, the assembly acts as a drain screen and particulate trap, preventing large articles and debris from being freely deposited into the drain.

Along the sidewalls 13 of the frame 11 is a mounting plate 14 that extends horizontally around the frame 11 and supports a plurality of fasteners 15 therethrough. The fasteners 15 are threaded members that connect to extendable footer elements 16 mounted along the exterior of the frame sidewalls 13. The footer elements 16 are bearing members that are adapted to be extended outward from the frame 11 and bear against the interior surface of an open drain, whereby the footer elements 16 extend from all sides of the frame 11 and secure the same in a working position within the drain interior. To extend the footers 16, a hand tool is utilized by an installer, which rotates the threaded fasteners 15 to advance the footers 16 outward from the frame. Once extended and bearing against the drain interior, the footers 16 support the frame 11 within the drain and prevent unauthorized removal thereof such that debris is trapped within the frame interior and prevented from entering into the drain. The fasteners 15 preferably have a specific key or chuck that allows their engagement with a given tool (tamper resistant security fasteners), whereby only authorized users can rotate the fasteners and obtain purchase of the fasteners 15 using the authorized tool key/chuck. The footers 16 include a first and second aperture to accept therethrough the fasteners 15, while an inner and outer nut 26 secures on the inner and outer sides of the footer 16 to force movement of the same along the fastener 15 length. Further description of this connection is shown in FIGS. 2 and 3, and is discussed below.

The base surface 18 of the assembly is an apertured or screen member that supports debris deposited into the frame interior. Positioned centrally along the base surface 18 is a hinged access door 19, which is adapted to provide a user with the ability to access the drain interior through the base surface 18 without first removing the frame 11 therefrom. This is critical when access to the drain is necessary for cleaning and snaking, as removal of the frame 11 is tedious and requires hand tools to accomplish. The hinged door further comprises a latch and locking means, whereby the ability to open the door 19 and thus obtain access through the frame 11 is limited to only those personnel with authorization to overcome the locking means.

Figure 2:
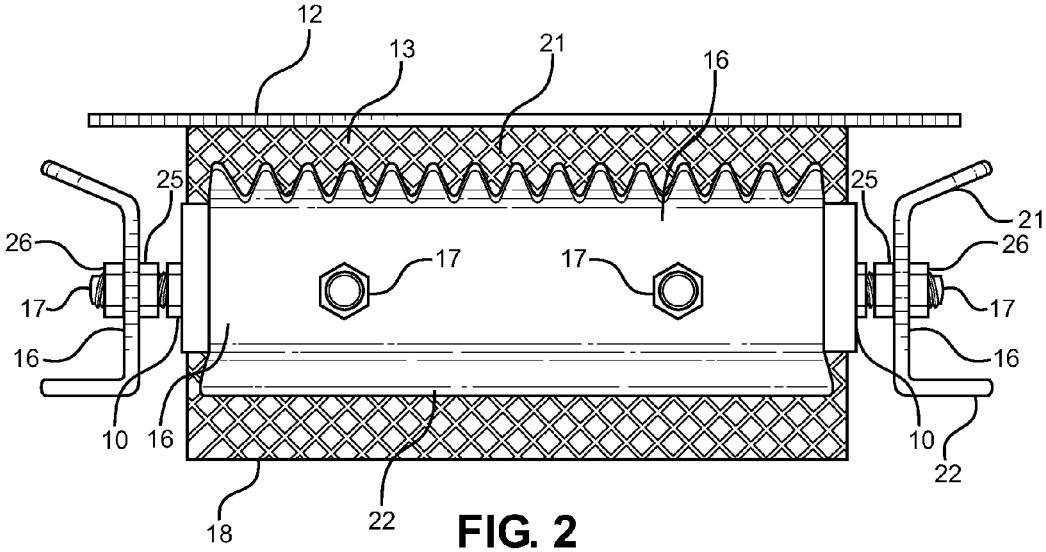
FIG. 2 shows a side view of the present invention.
Figure 3:
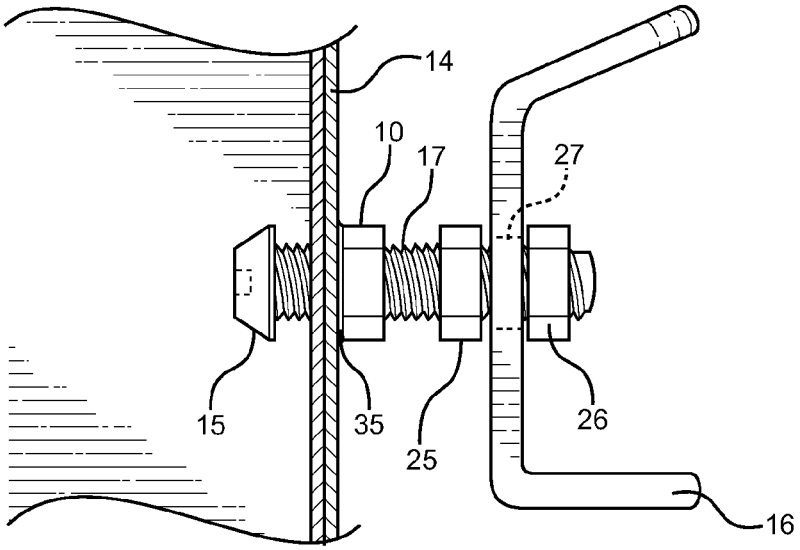
FIG. 3 shows a side view of the foot elements and their connection with the drain screen mounting plate.

Referring now to FIG. 2, there is shown a side view of the drain screen device of the present invention. In this view, the shape and position of the footer elements 16 is visualized. The footers 16 comprise largely rectangular structures having outwardly projecting teeth 21 along their upper edge and an outwardly extending ledge 22 along their lower edge. A pair of fasteners 17 controls the positioning of the footers 16 with respect to the frame sidewalls 13, and control the pressure exerted onto the drain interior surface when the footers 16 are extended and pressed thereagainst during installation. When installing the assembly, the upper surface ledge 12 of the frame is positioned above the open drain, while the base surface 18 and frame of the device are positioned within the drain interior. Once therein, the footers 16 are extended to securably lock the assembly in position within the drain and prevent unauthorized removal of the assembly therefrom.

The assembly is secured into position within the drain using the extended footers 16, whereby the footers 16 are extendably controlled using tamper resistant security fasteners 17. The fasteners 17 may include a specific key or non-standard engagement for rotating the head of the fastener. In this way, cleaning personnel and workers cannot choose to remove the drain when cleaning, which is sometimes done in commercial environments for expediency sake. Therefore, large objects such as large food particles, utensils, glass, napkins and other objects either intentionally or accidentally allowed into drain are prevented from entering thereinto by way of the secured positioning of the assembly and the tamperproof fasteners. Ideally the assembly is designed for installation into a floor sink in a restaurant or other establishment to keep objects out of the drain. The dimensions and shape of the assembly frame can be tailored to different drain sizes to accommodate different applications.

Referring now to FIGS. 2 and 3, the engagement of the fasteners 17 with respect to the footers 16 is visualized. Each fastener 17 is threadably connected through a base nut 10, which is welded 35 to the mounting plate. Rotation of the fastener 17 extends the outer extent of the fastener away from the mounting plate. Along the fastener length is first (inner) nut 25 and a second (outer) nut 26 positioned along opposite sides of the footer 16. The fastener extends through these nuts 25, 26 and through the aperture 27 in the footer 16. The aperture 27 is oversized with respect to the fastener 17 diameter, whereby the fastener 17 threads do not engage any part of the footer 16 itself. Rather, rotation of the fastener 17 extends the fastener outward, wherein the inner nut 25 and outer nut 26 bear against the footer 16 to displace it outward and to force it against the interior of a drain. In this way, the footers 16 can be positioned relative to the mounting plate by rotation of the nut, which is only turned using an appropriate tool. Therefore, the assembly is mounted within a drain and removable only by authorized personnel.

Figure 4:
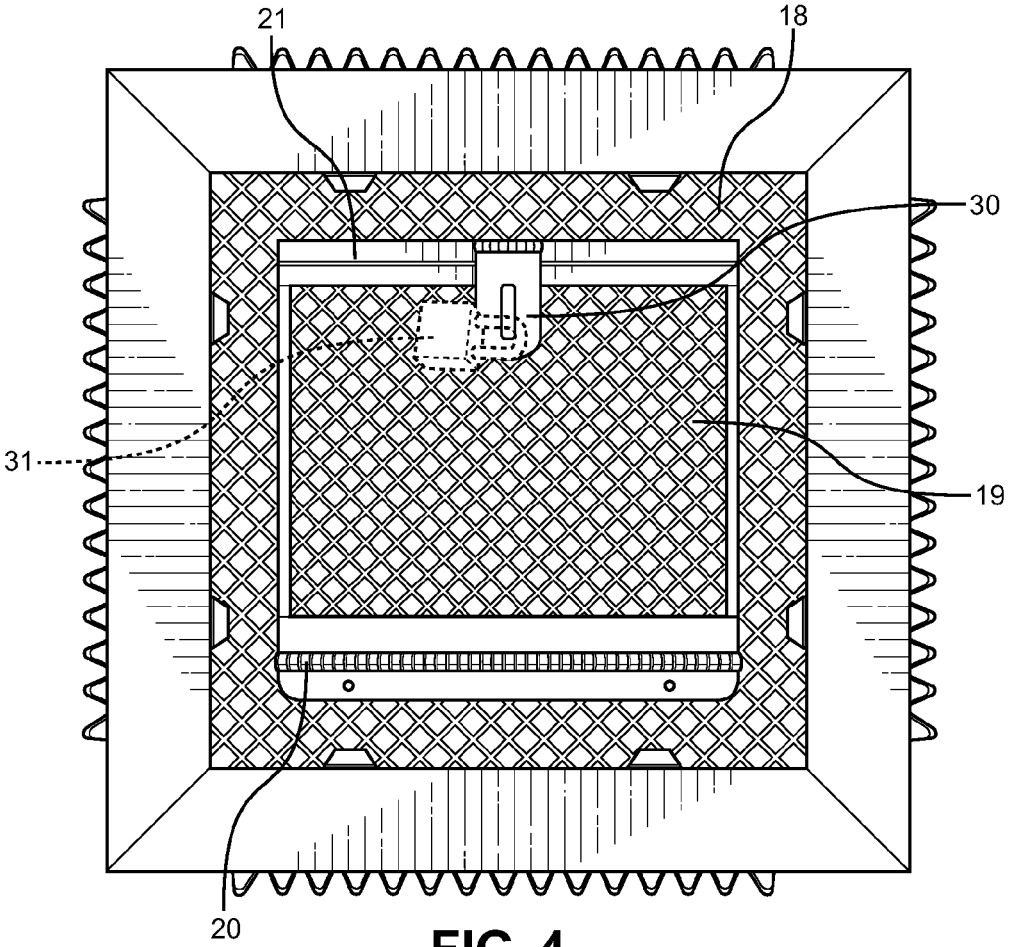
FIG. 4 shows an overhead view of the present invention.

Referring now to FIG. 4, there is shown an overhead view of the drain screen of the present invention. From this view, the base surface 18 of the frame is readily visualized, along with the positioning of the hinged access door 19 thereon. The door 19 comprises a screen or apertured surface having a first hinged edge 20 and a second, securable edge 21. The hinged edge 20 further comprises a hinge joint between the door 19 and the base surface 18 that permits rotation of the door 19 from an aligned position with respect to the base surface 18 to an open configuration for access through the base surface. The securable edge 21 further comprises a latch 30 that is adapted to accept a padlock 31 or similar locking means that secures the door 21 in its closed position (aligned with the base surface). The lock 31 prevents unauthorized personnel from opening the door 19 and thus bypassing the drain screen of the present invention.

Figure 5:
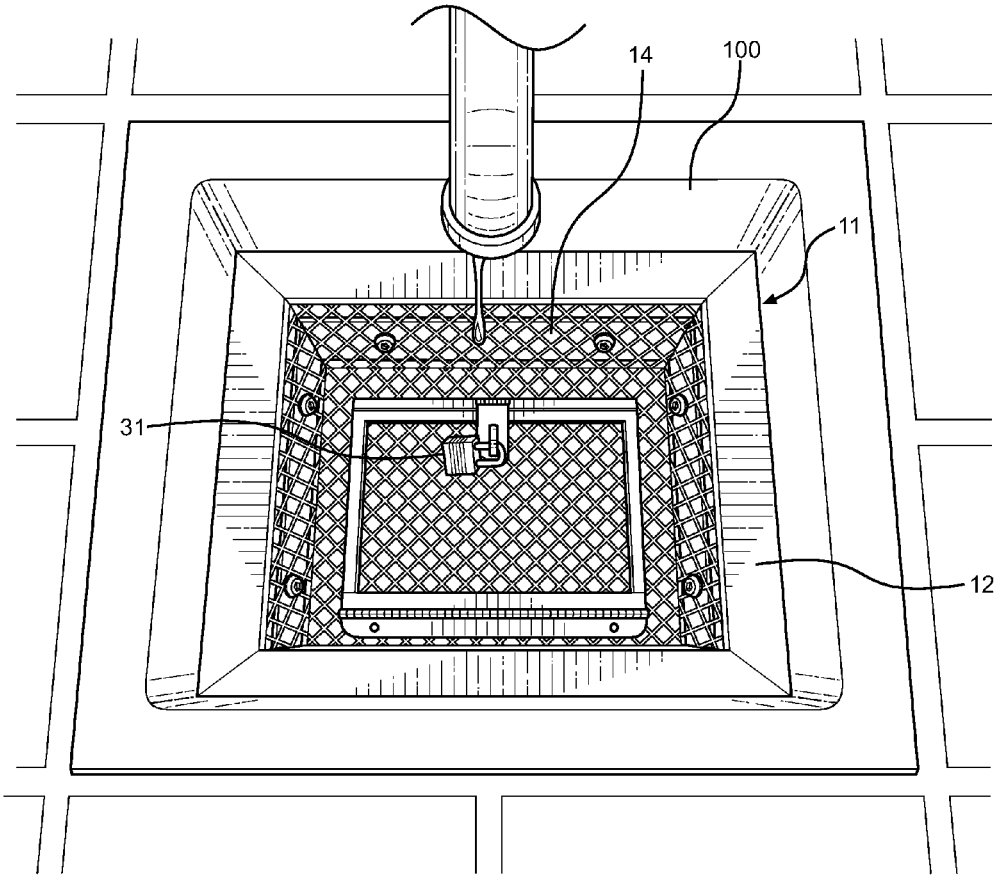
FIG. 5 shows an overhead view of the drain screen in a working state, lockably secured within a drain and actively blocking large debris from passing therethrough.

Referring now to FIG. 5, there is shown an overhead view of the present invention in a working state, installed within a drain 100 and actively preventing debris from entering thereinto while allowing fluid to pass therethrough. When installed, the frame 11 rests within the drain interior while the upper ledge surface 12 rests just above the drain. The footer elements are extended outward and bear against the drain interior to prevent removal of the frame 11, while the door 19 remains in a closed and locked 31 position while in a working state. When access to the drain is required, the lock 31 can be removed and the access door 19 opened to permit snaking and cleaning activities to commence without completely removal of the frame 11 from within the drain 100.

In addition to installing the device into a drain to physically block material from being entered thereinto, the present invention also provides a useful platform upon which a secondary basket or catch basin may be placed. The upper ledge surface 12 provides a location upon which the lower extent of a secondary basket may be placed when the present invention is deployed. The secondary basket is useful as a means to catch large items, such as towels and napkins throw at the drain, while the basket can readily be removed from the area and cleaned without reaching into the interior of the frame 11 and without removing the assembly from the drain interior.

When floor drains become clogged with objects and debris, fluid cannot adequately pass through the drain and a backup can quickly occur. This back-up of fluid can create flooding and freestanding puddles on the floor, causing slipping hazards, water damage, and injuries in commercial environments. Large amounts of backed-up water can cause extensive damage and make conditions unsanitary within the interior space, which can be expensive and time consuming to fix. In addition, if large objects are stuck in the drain, a plumber might be required to remove pipes, which can add unnecessary expense and repairs. If not corrected, clogged drains can cause odor and possible down time, which can lead to loss of revenue.

The present invention describes a locking drain screen and sediment basket. The device comprises a rectangular frame with extendable footer elements along the sides thereof, and a lockable access door through the base surface of the frame. The frame is secured and locked in position with tamper resistant security fasteners and a lockable latch. This prevents the assembly from being removed without authorization by those who would place foreign objects into the drain can cause clogs. The assembly also prevents utensils, glasses, large food particles, and other objects from going down floor sink drains in restaurants and other commercial spaces. Use of the present invention ensures draining systems are working properly, preventing possible damage, and helps eliminate the hassle of trying to fix a clogged drain. The frame is preferably comprised of a perforated, stainless steel material formed into a basket shape.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain screen assembly, comprising:

a largely rectangular frame having a base surface, upstanding sidewalls, and an open upper;

an upper ledge surface extending outwardly from an upper edge of said upstanding sidewalls;

extendable footer elements mounted along an exterior surface of said sidewalls;

said extendable footer elements being extendably positionable and controlled by at least one threaded fastener through said footer element and said frame upstanding sidewall;

said frame base surface and upstanding sidewalls having a perforated surface to restrict debris and permit fluid passage thereacross.

2. The drain screen assembly of claim 1, wherein said frame upstanding sidewalls further comprise a mounting plate for supporting said fasteners therethrough.

3. The drain screen assembly of claim 1, wherein said fasteners further comprise non-standard heads adapted to provide tamper resistance.

4. The drain screen assembly of claim 1, wherein said footer elements further comprise elongated rectangular members having an outwardly extending lower ledge and an upper edge comprising outwardly projecting teeth.

5. The drain screen assembly of claim 1, wherein:

said base surface further comprising an access door having a first hinged edge and a latchable second edge;

a latch positionable over said access door latchable second edge and said frame base surface, said latch adapted to provide attachment of a locking means.

* * * * *